US006049682A

United States Patent [19]

Goetzke et al.

[11] Patent Number: 6,049,682

[45] Date of Patent: Apr. 11, 2000

[54] HARD CARTRIDGE PACKAGE FOR AN ORGANIC PHOTORECEPTOR BELT

[75] Inventors: Donald J. Goetzke, Woodbury; Randy A. Bierwerth, Oakdale; James E. Zenk, St. Paul; John D. Watson, Centerville; Bruce W. Carlson, Minneapolis, all of Minn.

[73] Assignee: Imation Corp., Oakdale, Minn.

[21] Appl. No.: 09/208,971

[22] Filed: Dec. 10, 1998

[51] Int. Cl.[7] ..... G03G 15/00; G03G 21/00

[52] U.S. Cl. ..... 399/116; 206/303; 399/162

[58] Field of Search ..... 399/116, 117, 399/159, 162, 107, 110, 111; 206/303, 316.1, 493

[56] References Cited

U.S. PATENT DOCUMENTS

| | | | |
|---|---|---|---|
| 3,877,806 | 4/1975 | Schrempp et al. | 399/161 |
| 3,888,577 | 6/1975 | Meyer | 399/116 |
| 4,009,958 | 3/1977 | Kurita et al. | 399/165 |
| 4,319,829 | 3/1982 | Janeway, III et al. | 399/165 |
| 4,544,260 | 10/1985 | Kolbe | 399/111 |
| 4,766,455 | 8/1988 | Carter | 399/116 |
| 4,811,839 | 3/1989 | Cornell et al. | 206/303 |
| 5,065,195 | 11/1991 | Haneda et al. | 399/112 |
| 5,119,133 | 6/1992 | Swain | 399/163 |
| 5,400,121 | 3/1995 | Foote | 399/116 |
| 5,417,322 | 5/1995 | Jeran et al. | 206/303 |
| 5,708,924 | 1/1998 | Shogren et al. | 399/116 |
| 5,809,375 | 9/1998 | Owens, Jr. et al. | 399/111 |
| 5,819,139 | 10/1998 | Harlan et al. | 399/110 |
| 5,887,229 | 3/1999 | Sass et al. | 399/116 |

FOREIGN PATENT DOCUMENTS

| | | |
|---|---|---|
| 0 871 079 A1 | 10/1998 | European Pat. Off. . |
| 0 892 313 | 1/1999 | European Pat. Off. . |

*Primary Examiner*—Arthur T. Grimley
*Assistant Examiner*—Sophia S. Chen
*Attorney, Agent, or Firm*—William D. Bauer

[57] ABSTRACT

Disclosed is a cartridge device for packaging an endless, organic photoreceptor belt of an electrophotographic printer. The cartridge device includes a substantially rigid, closed loop support structure and a resilient mechanism. The resilient mechanism engages the endless belt and releasably holds the belt against an inner surface of the support structure. The resilient mechanism holds the endless belt so that the belt substantially conforms to the shape of the support structure. The shape of the support structure essentially duplicates the configuration of the endless belt when the belt is mounted onto support rollers of the electrophotographic printer. By replicating the configuration of the support rollers, loading of a replacement photoreceptor belt onto the rollers is facilitated using the cartridge device. The cartridge device substantially protects the photoreceptor belt from inadvertent damage that would adversely affect the image reproduction quality of the replacement belt.

22 Claims, 10 Drawing Sheets

HARD CARTRIDGE PACKAGE FOR AN ORGANIC PHOTORECEPTOR BELT

CROSS REFERENCE TO RELATED APPLICATIONS

This patent is related to U.S. patent application Ser. No. 08/809,298, entitled "Protective Cover Package for an Organic Photoreceptor Belt" filed on even date herewith and assigned to the same assignee; and to U.S. patent application Ser. No. 09/209,189, entitled "Soft Cartridge Package for an Organic Photoreceptor Belt" also filed on even date herewith and also assigned to the same assignee.

TECHNICAL FIELD

This invention relates to electrophotographic printers that employ organic photoreceptor belts. In particular, the present invention is a hard cartridge package that allows a user to load a new organic photoreceptor belt into an electrophotographic printer without damaging or otherwise adversely affecting the image producing quality of the new belt.

BACKGROUND OF THE INVENTION

Throughout the business world, electrophotographic printers are extensively used for image reproduction. To effect image reproduction, one type of electrophotographic printer employs a belt having an organic photoreceptor coating thereon. As a result of various wear factors, the life span of the organic photoreceptor coating on the belt is less than the life span of the electrophotographic printer, thereby requiring that the organic photoreceptor coated belt be periodically replaced. The life span of the organic photoreceptor belt is limited because the organic photoreceptor coating layers deteriorate over time as a result of continued exposures to the imaging process. Consequently, the characteristics of the organic photoreceptor belt change and thereby adversely affect the quality of the reproduced image. In addition, the organic photoreceptor coating of the belt may include a release layer which tends to change its surface properties over time. The surface property changes of this release layer adversely affect the image quality of subsequent reproductions.

Within the business environment, the task of periodically replacing the organic photoreceptor coated belt is typically accomplished by office personnel instead of electrophotographic printer service technicians. To allow office personnel to perform the task of organic photoreceptor belt replacement, the organic photoreceptor belt is packaged (with other consumables) within a rigid cartridge. By packaging the organic photoreceptor belt within a cartridge, organic photoreceptor belt replacement is more easily performed by office personnel. In addition, the cartridge also protects the fragile organic photoreceptor coating of the belt from damage that can easily occur during the organic photoreceptor belt replacement process. Typically, the process of used organic photoreceptor belt replacement is accomplished by completely exchanging the old cartridge containing the used organic photoreceptor belt (and other consumables) for a new cartridge containing an unused organic photoreceptor belt (and other consumables). Although it may not be necessary to replace the other consumables contained within the cartridge since they may have a longer life than the belt (such as the belt rollers, etc.), the entire cartridge is replaced.

Although the above described, typical, organic photoreceptor belt replacement cartridge design facilitates belt replacement and protects the organic photoreceptor coated belt from inadvertent damage, there are some disadvantages to this design. For example, since organic photoreceptor belt replacement also requires that an old cartridge be replaced with a new cartridge, the process of belt replacement creates a significant amount of consumables that must be disposed of. Not only is the used organic photoreceptor belt thrown away but the typical cartridge design necessitates that the used belt cartridge be disposed of with the used belt. All of the consumables within the cartridge are replaced, even though the organic photoreceptor belt may be the only item requiring replacement. This is of particular concern today with the ever increasing emphasis on decreasing office environment consumables. Moreover, the design of the typical, rigid organic photoreceptor belt cartridge typically requires intricately shaped parts to accommodate the organic photoreceptor belt support roller configuration of the electrophotographic printer. This translates into higher costs to manufacture organic photoreceptor belt cartridges and thereby higher consumer costs for replacement organic photoreceptor belts. In addition, these intricately shaped parts are generally manufactured of heavy materials which in turn results in a heavy organic photoreceptor belt cartridge. This weight translates into higher costs for shipping organic photoreceptor belts and, as before, higher consumer costs for replacement organic photoreceptor belts.

There is a need for an improved cartridge for packaging replacement organic photoreceptor belts. In particular, there is a need for cartridge package that not only facilitates organic photoreceptor belt replacement and protects the replacement organic photoreceptor coated belt from inadvertent damage during the replacement process, but minimizes the amount of consumables that must be disposed of as a result of organic photoreceptor belt replacement. The cartridge package should be easy to use so as to allow office personnel to quickly and correctly perform the task of organic photoreceptor belt replacement. In addition, the cartridge package configuration, for the replacement organic photoreceptor belt, should be of minimal shipping weight, so as to minimize shipping costs. Lastly, the organic photoreceptor belt cartridge should provide these features while being relatively easy and inexpensive to manufacture.

SUMMARY OF THE INVENTION

The present invention is a cartridge device for packaging an endless organic photoreceptor belt of an image forming apparatus, such as an electrophotographic printer. The cartridge device is defined by a substantially rigid, closed loop structure having an inner and an outer surface. A retaining mechanism associated with the support structure engages the endless organic photoreceptor belt and releasably holds the belt against the inner surface of the support structure. The retaining mechanism holds the endless organic photoreceptor belt to the support structure, such that the endless belt substantially conforms to the shape of the support structure. By holding the endless organic photoreceptor belt in this manner, the support structure can protect the outer, photoreceptor coated surface of the belt from damage that would adversely affect the image reproduction quality of the endless organic photoreceptor belt.

The shape (i.e., configuration) of the substantially rigid, closed loop support structure substantially duplicates a configuration of the endless organic photoreceptor belt when the belt is mounted onto support rollers of the image forming apparatus. This configuration facilitates loading of the belt onto the support rollers.

In one embodiment, the closed looped support structure has a first open end and an opposite second open end, wherein the cartridge device includes a cap feature for closing off the first open end and the closed loop support structure. The closed loop support structure may include first and second, opposite side edges, wherein a peripheral edge of the cap member includes a channel adapted to receive the first side edge of the support structure for mounting the cap feature to the support structure. The cap feature may include a handle to facilitate handling of the cartridge device. The closed loop support structure and the cap feature may comprise a single molded unit.

Optionally, the retaining mechanism may be mounted to the cap member of the cartridge device. The retaining mechanism may include a plurality of spaced resilient members that extend from the cap member toward the second open end of the closed loop support structure, the retaining members engaging an inner surface of the photoreceptor belt to hold the photoreceptor belt against the inner surface of the support structure.

Each of the resilient members may include a proximal end and a distal end, wherein a peripheral edge of the cap member includes a plurality of spaced apertures adapted to receive the proximal ends of the resilient members for mounting the resilient members to the cap member of the cartridge device. Each of the resilient members may be covered with a protective coating to protect the endless photoreceptor belt. The distal end of the each of the resilient members may be formed with an angled bend portion that extends away from the inner surface of the closed loop structure.

In one aspect the retaining mechanism is movable between a first position and a second position, wherein one of the first and second positions is a normal set state of the retaining mechanism and the other one of the first and second positions is held in that state by an external force. In the first position of the retaining mechanism the endless photoreceptor belt is substantially held against the inner surface of the support structure by holding a force provided by the retaining mechanism. In the second position of the retaining mechanism, the endless photoreceptor belt is disengaged from the inner surface of the support structure which at least partially overcomes (i.e., counters or opposes) the holding force provided by the retaining mechanism.

In one aspect, the first position of the retaining mechanism is the normal set state of the retaining mechanism. The movement of the retaining mechanism between its first and second positions is due to flexing of the retaining mechanism. The endless photoreceptor belt is loaded onto the support rollers of the image forming apparatus by inserting the closed loop support structure with the belts supported therein over the support rollers, and wherein tensioning of the belt on the support rollers provides the external force that causes the retaining mechanism to flex from its first position to its second position, allowing the closed loop support structure to be removed from around the belt and the support rollers, leaving only the belt on the support rollers of the image forming apparatus.

Organic photoreceptor belt replacement is accomplished by first removing the used organic photoreceptor belt from the support rollers of the image forming apparatus. Next, the cartridge device with the replacement organic photoreceptor belt supported therein, by way of the retaining mechanism, is aligned with the support rollers such that the configuration of the cartridge matches the configuration of the rollers. The cartridge device is then moved over the support rollers until the cartridge device, with the organic photoreceptor belt therein, is fully on the support rollers of the image forming apparatus. Next, the replacement organic photoreceptor belt is tensioned, and then the cartridge device is slid out from around the replacement organic photoreceptor belt and the support rollers leaving only the organic photoreceptor belt on the rollers.

In another embodiment, the present invention provides a method of loading an endless photoreceptor belt onto support rollers of a support rollers system of an image forming apparatus. The method includes the step of providing a cartridge device including a substantially rigid, closed loop support structure having a retaining mechanism for releasable holding an endless photoreceptor belt against an inner surface of the support structure, the support structure with the belt therein having a configuration that substantially duplicates a configuration of support rollers of the image forming apparatus. The closed loops support structure is aligned with the support rollers of the imaging forming apparatus such that the configuration of the support structure matches the configuration of the support rollers. The closed loop support structure is moved onto the support rollers such that the support structure, with the endless photoreceptor belt supported therein, is fully on the support rollers. The endless photoreceptor belt is tensioned on the support rollers so as to fix the belt against movement relative to the support rollers. The closed loop support structure is removed from around the endless photoreceptor belt and the support rollers leaving only the belt on the support rollers of the image forming apparatus to make the belt ready for image reproduction.

The step of tensioning the endless photoreceptor belt on the support rollers may include the step of flexing the retaining mechanism to disengage the belt from the inner surface of the support structure. The retaining mechanism may include a plurality of spaced resilient members and wherein the step of aligning the closed loop support structure with the support rollers includes the step of aligning the spaced resilient members with corresponding notches on a tip member associated with the support rollers. The cartridge device further includes a cap feature, and wherein the step of removing the closed loop support structure from around the endless photoreceptor belt and the support rollers includes the step of grasping a grip mechanism on the cap member to facilitate removal of the support structure from around the belt and the support rollers.

The cartridge device of the present invention protects the organic photoreceptor belt from damaging bends and creases that would adversely affect the image reproduction quality of the replacement organic photoreceptor belt. In addition, the cartridge device protects the fragile organic photoreceptor coating of the belt from other damage, in the form of finger prints, scratches and/or abrasions, caused by organic photoreceptor belt mishandling during the replacement process. The cartridge device provides protection during the organic photoreceptor belt replacement process since personnel need only touch the support structure of the cartridge device during the replacement process and not the organic photoreceptor belt itself. In addition to providing organic photoreceptor belt protection, the cartridge device of the present invention minimizes, when compared to prior art cartridge designs, the amount of consumables that must be disposed of as a result of the organic photoreceptor belt replacement process, since the cartridge device is reusable and/or recyclable. Moreover, the cartridge device of the present invention is manufactured of light weight materials so as to minimize the shipping weight of the organic photoreceptor belt replacement, which in turn minimizes shipping costs. Lastly, this organic photoreceptor belt cartridge device also provides these features while being relatively easy and inexpensive to manufacture.

BRIEF DESCRIPTION OF THE DRAWINGS

The accompanying drawings are included to provide a further understanding of the present invention and are incorporated in and constitute a part of this specification. The drawings illustrate the embodiments of the present invention and together with the description serve to explain the principals of the invention. Other embodiments of the present invention and many of the intended advantages of the present invention will be readily appreciated as the same become better understood by reference to the following detailed description when considered in connection with the accompanying drawings, in which like reference numerals designate like parts throughout the figures thereof, and wherein.

DETAILED DESCRIPTION OF THE PREFERRED EMBODIMENTS

Figure 1:
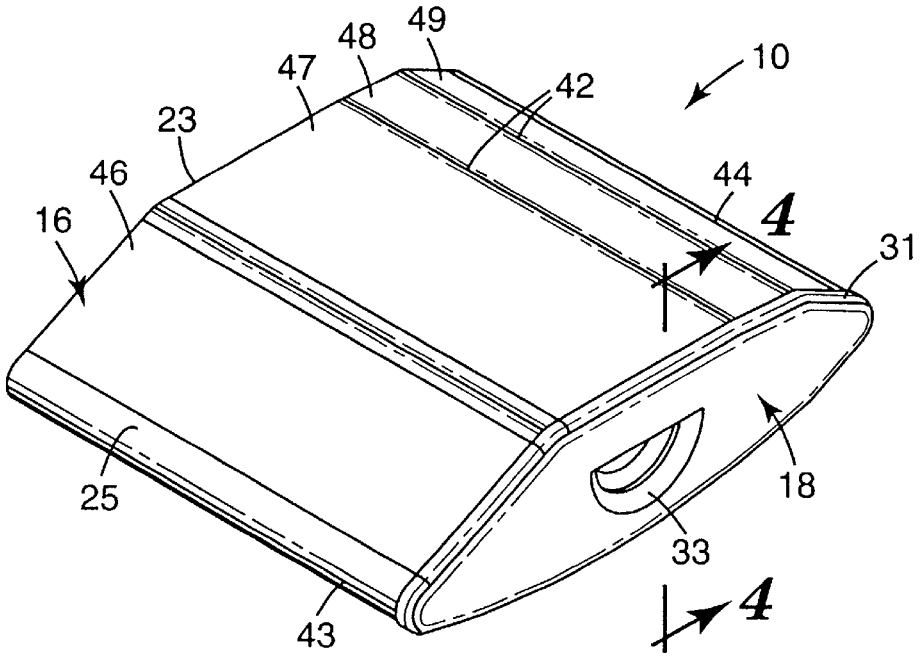
FIG. 1 is a perspective view illustrating a front side of a cartridge device for packaging replacement, endless, organic photoreceptor belts for an electrophotographic printer in accordance with the present invention.

A hard cartridge device 10 for packaging an endless, organic photoreceptor belt 12 (seen best in FIGS. 2 and 3) of an image forming apparatus, such as a belt transport system in an electrophotographic printer, in accordance with the present invention is illustrated generally in FIGS. 1–5. One exemplary embodiment of an electrophotographic system is described in detail in a pending patent application filed Sep. 29, 1995, assigned to 3M Company, designated as U.S. patent application Ser. No. 08/537,296, entitled "A Method and Apparatus for Producing a Multi-Color Image in an Electrophotographic System" (Kellie et al.). This pending patent application is incorporated herein by reference. The hard cartridge device 10 includes a substantially rigid, closed loop support structure 16, a substantially rigid, cap member 18 and a retaining mechanism 20. As seen best in FIG. 4, the support structure 16 has first and second side edges 22 and 23, and inner and outer surfaces 24 and 25, respectively. The first and second side edges 22 and 23 define first and second, opposite, open ends 26 and 27, respectively, of the support structure 16.

Figure 4:
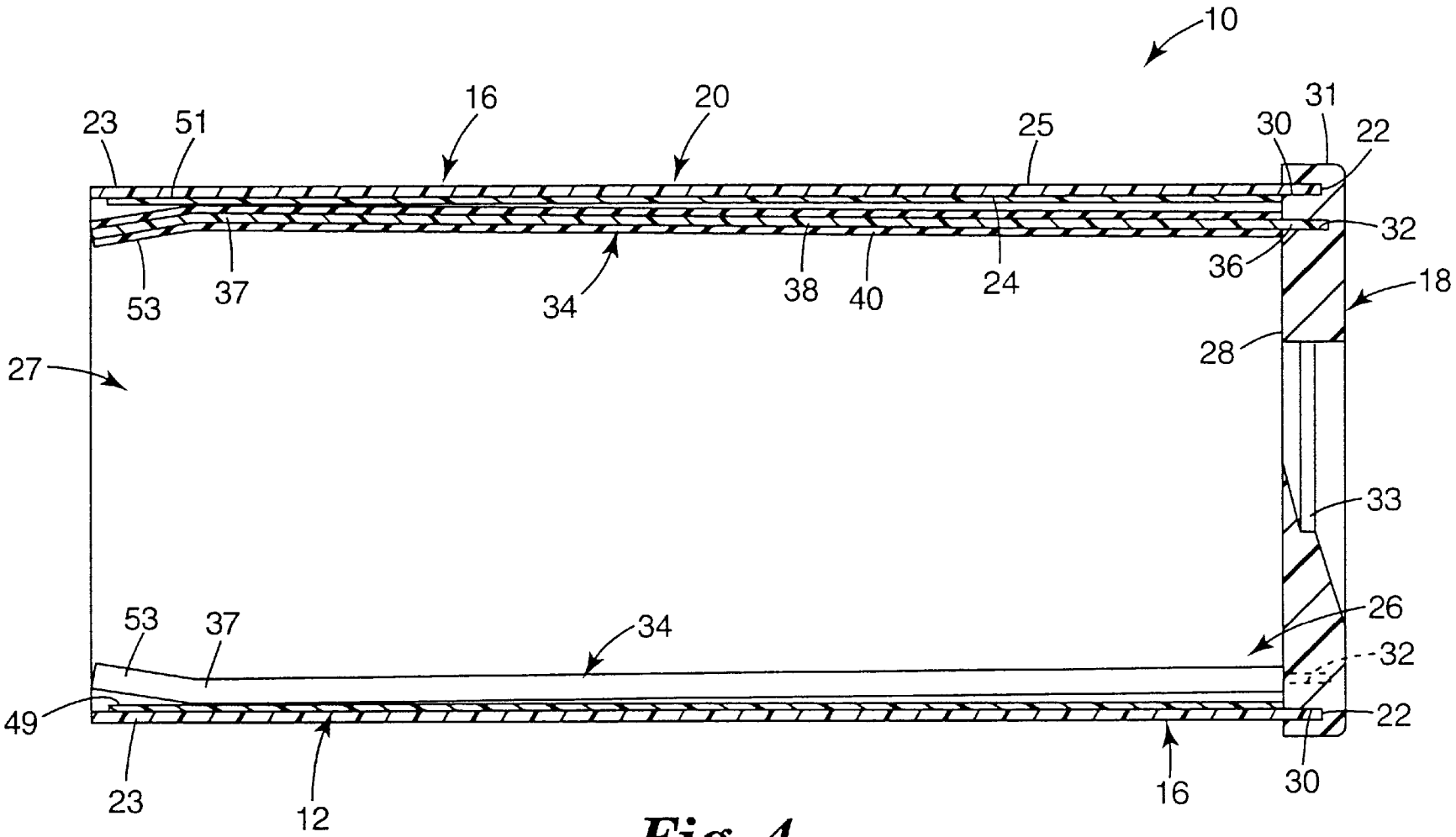
FIG. 4 is a sectional view taken along line 4—4 in FIG. 1 further illustrating the resilient mechanism of the cartridge device.

As shown in FIG. 4, the first open end 26 of the support structure 16 is closed off by the cap member 18. To mount the cap member 18 to the support structure 16, an inner surface 28 of the cap member 18 includes a continuous channel 30. The channel 30 is located proximate to a peripheral edge 31 of the cap member 18, and is sized to receive the first side edge 22 of the support structure 16. A suitable adhesive, such as epoxy, secures the first side edge 22 within the channel 30 of the cap member 18. Located further inboard of the channel 30, the inner surface 28 of the cap member 18 further includes a plurality of spaced apertures 32 (only two of which can be seen in FIG. 4) for mounting the retaining mechanism 20 to the cap member. The cap member 18 also includes a handle 33 that facilitates handling of the hard cartridge device 10.

In one preferred embodiment, the closed loop support structure 16 of the hard cartridge 10 is formed using a suitable rigid plastic via an extrusion process. The closed loop support structure 16 is then cut to the desired length to accommodate the particular size of the organic photoreceptor belt 12. The cap member 18 of the hard cartridge device 10 is injection molded to shape using a suitable rigid plastic. The channel 30, apertures 32 and handle 33 of the cap member 18 are formed during the molding process. The substantially rigid nature of the support structure 16 and the cap member 18 influences the use of the term "hard" to describe the cartridge device 10. Other methods for making hard cartridge 10 in accordance with the present invention will become apparent to those skilled in the art after reading the disclosure of the present application. For example, in another exemplary embodiment, the closed loop support structure 16 and a cap member 18 may be molded in one piece. Support structure 16 and cap member 18 may be injection molded in halves (e.g., similar to a "clam shell" design) and joined via bonding, mechanical fastening, snap fit features, etc. Such a design can incorporate the cap features into the shell walls. Other manufacturing processes include stamping metal side panels and assembling the container with a plastic frame (cap, side molding, etc.), although more assembly may be required then the previously mentioned injection moldings designs. Other molding processes suitable for use in manufacturing the present invention include blow molding, rotational molding, thermal forming, etc.

Retaining mechanism 20 operates to securely retain the organic photoreceptor belt 12 within hard cartridge device 10 without damaging the organic photoreceptor belt 12. The retaining member 20 also allows the organic photoreceptor belt 12 to be transferred to the belt transport system of an electrophotographic printer without incurring damage in the belt. The retaining mechanism 20 may comprise a resilient member having an inherent spring force for retaining the organic photoreceptor belt 12 within the closed loops port structure 16, or may include other coupling mechanisms, such as a device which magnetically couples the organic photoreceptor belt 12 against the closed loop support structure 16. Other embodiments of retaining mechansims 20 will become apparent to those skilled in the art after reading the disclosure of the present invention.

Figure 2:
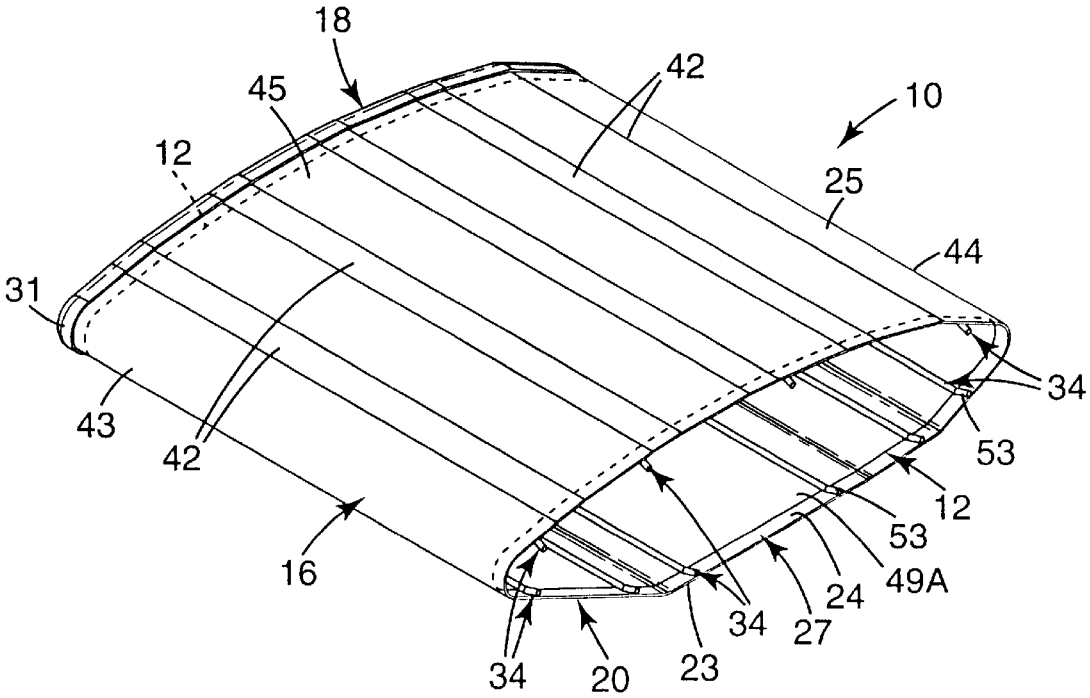
FIG. 2 is a perspective view opposite to that shown in FIG. 1 illustrating a rear side of the cartridge device.
Figure 3:
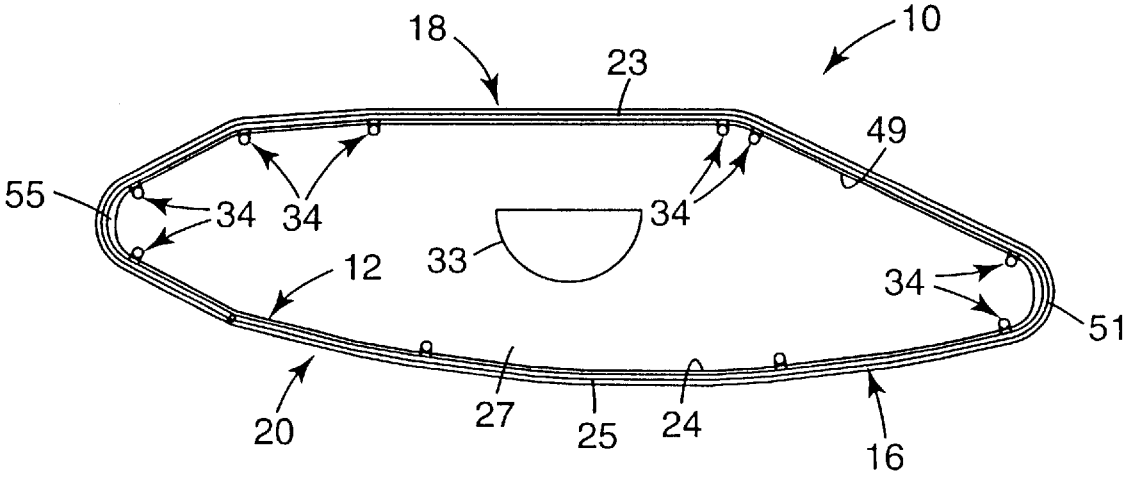
FIG. 3 is an end elevational view of the cartridge device of FIG. 1 illustrating the resilient mechanism of the cartridge device.

As seen best in FIGS. 2–4, in one exemplary embodiment the retaining mechanism 20 includes a plurality of spaced resilient members 34 that extend from the cap member 18 toward the second open end 27 of the support structure 16. In the exemplary embodiment shown, each resilient member 34 is a "rod-shaped" member. Each of the resilient members 34 has a proximal end 36 and a distal end 37. The proximal end 36 of each resilient rod 34 is adapted to be received by a respective aperture 32 for mounting the resilient members 34 to the cap member 18 of the hard cartridge device 10. Preferably, the resilient members 34 are secured within the apertures 32 via a close friction fit. This would allow broken resilient members to be readily replaced, and would thereby enhance the reusable feature of the hard cartridge device 10. As shown in FIG. 4, each resilient rod 34 is defined by a rod member 38 that is covered, outboard of the cap member 18, with an elastic coating 40. In one preferred embodiment, there are a total of ten resilient members 34, with each rod member 38 being injection molded from a suitable resilient plastic with the elastic coating 40 being made of rubber. However, other materials, such as metal for the rod members 38 and plastic for the elastic coating 40 could be used to manufacture acceptable resilient members 34.

As seen in FIGS. 1–3, the support structure 16 of the hard cartridge device 10 has a plurality of widthwise extending prebends 42. These prebends 42 (formed during the support structure manufacturing process) dictate the particular shape of the support structure 16 defined by end regions 43 and 44, curved bottom region 45, and planar regions 46, 47, 48 and 49. This particular shape or configuration is the normal, set shape of the support structure 16 and is referred to as a belt loading configuration of the hard cartridge device 10. The peripheral edge 31 of the cap member 18 is shaped so as to duplicate this belt loading configuration of the support structure 16. The belt loading configuration of the support structure 16 of the hard cartridge device 10 substantially duplicates the configuration of the endless organic photoreceptor belt 12 (see FIG. 5) when the belt 12 is mounted on a support roller system 50 of the electrophotographic printer 14. As will become clear below, by duplicating the configuration of the organic photoreceptor belt 12 on the support roller system 50 (and therefore the configuration of the support roller system 50 itself), the belt loading configuration of the hard cartridge device 10 also facilitates loading of the belt 12 onto the support roller system 50 of the electrophotographic printer 14.

As shown in FIGS. 2–4, the resilient members 34 are mounted within the apertures 32 of the cap member 18 such that the resilient members 34 normally rest against the inner surface 24 of the support structure 16. In use, the resilient members 34, in their normal set state (i.e., first position) engage an inner surface 49A of the organic photoreceptor belt 12 to releasably hold an outer organic photoreceptor coated surface 51 of the organic photoreceptor belt 12 against the inner surface 24. The support structure 16 of the hard cartridge device 10 protects the fragile outer organic photoreceptor coated surface 51 of the organic photoreceptor belt 12 from damage, in the form of scratches and abrasions, that would otherwise adversely affect the image reproduction quality of the organic photoreceptor belt 12. In addition, the elastic coating 40 on the rod members 38 of the resilient members 34 helps to prevent the occurrence of damaging bends and creases in the organic photoreceptor belt 12 that would also adversely affect the image reproduction quality of the organic photoreceptor belt 12. Coating 40 protects the backside of the organic photoreceptor belt 12 from scratches or other abrasions, and provides for frictional contact between the organic photoreceptor belt 12 and the rod members 38.

Optionally, a liner 49B (shown in FIG. 10) may be attached to the inner surface 49A of hard cartridge 10. The liner 49B may comprise a material or coating on inner surface 49A having properties such that the inner surface 49A does not damage or abrade the surface of organic photoreceptor belt 12. In one exemplary embodiment, the liner 49B is made of a non-woven material which is bonded to the inner surface of support structure 16. One known non-woven material is a liner material commercially available under the Trademark "Hovoliner", commercially available from Hollingsworth & Vose Co., of East Walpole, Mass. In another exemplary embodiment, the liner 49B comprises a polymeric coating. Other suitable liner materials will become apparent to those skilled in the art after reading the disclosure of the present application.

As seen best in FIG. 4, the distal end 37 of each of the resilient members 34 is formed with an angled bend portion 53 that extends away from the inner surface 24 of the closed loop support structure 16. These angled bend portions 53 together with the inner surface 24 act as a guide to facilitate the loading of a new, replacement organic photoreceptor belt 12 into the support structure 16 of the hard cartridge device 10. Once the new, replacement organic photoreceptor belt 12 is properly loaded into the hard cartridge 10, a cover (not shown) closes off the second open end 27 of the support cartridge 16 to complete the packaging of the replacement organic photoreceptor belt 12. The cover protects the organic photoreceptor belt 12 from light and other harmful contaminants during shipping and storage of the hard cartridge packaged replacement organic photoreceptor belt 12. Such covers can be made of foil, plastic, polystyrene, or other protective material.

The organic photoreceptor belt 12 is releasably held against the inner surface 24 such that the organic photoreceptor belt 12 substantially conforms to the shape of the support structure 16. As shown best in FIG. 3, most of the surface area of the organic photoreceptor coated surface 51 of the organic photoreceptor belt 12 contact the inner surface 24, however, there is a gap between the organic photoreceptor belt 12 and the inner surface 24 at the end region 44 of the support structure 16. Gap 55 allows for tensioning of belt 12 on the belt transport system. The purpose of the gap 55 will become more clear below.

Figure 5:
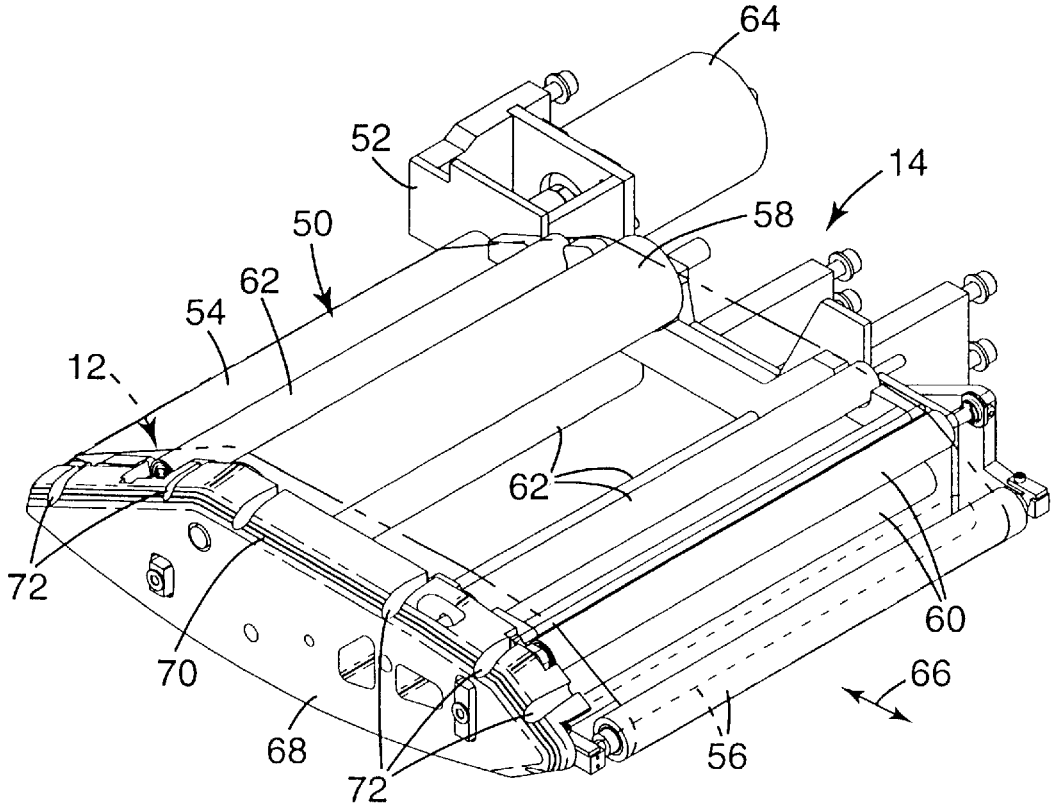
FIG. 5 is a perspective view of a support roller system for the organic photoreceptor belt of the electrophotographic printer.

As seen best in FIG. 5, the support roller system 50 of the electrophotographic printer 14 belt transport system (partially shown) includes a mounting frame 52 having a drive roller 54, a belt tensioning roller 56, a primary nip roller 58, a pair of stabilizing rollers 60, and a plurality of idler rollers 62 (only some of which can be seen in FIG. 5). The drive roller 54 rotates in a known manner via a drive motor 64 to move the endless organic photoreceptor belt 12 about the support roller system 50. The belt tensioning roller 56 is longitudinally movable, in a known manner, in the direction of double headed arrow 66 to allow de-tensioning and tensioning of the organic photoreceptor belt 12 for organic photoreceptor belt replacement. In FIG. 5, the belt tensioning roller 56 is shown in an organic photoreceptor belt tensioned state in solid lines and in a belt de-tensioned state in dashed lines. The support roller system 50 further includes a tip member 68 having a cone shaped, peripheral edge 70 and a plurality of spaced notches 72 that correspond to the resilient members 34 of the hard cartridge device 10. As will become clear below, the cone shaped, peripheral edge 70 and the spaced notches 72 of the tip member 68 facilitate loading of a replacement organic photoreceptor belt 12 onto the support roller system 50 by guiding the hard cartridge device 10 over and onto the rollers 54, 56, 58, 60 and 62.

FIGS. 6–13 illustrate the operation of loading a replacement organic photoreceptor belt 12 onto the support roller system 50 of an electrophotographic printer 14 using the hard cartridge device 10 in accordance with the present invention. To begin, the belt tensioning roller 56 is moved (by a user, such as an office worker or automatically actuated, such as by the electrophotographic printer), to its de-tensioned state. The used organic photoreceptor belt is then simply slid off of the support roller system 50 and discarded. Then, with the belt tensioning roller 56 still in its de-tensioned state, the hard cartridge device 10, with the replacement organic photoreceptor belt 12 supported therein, is removed from its shipping/storage container, and the cover is removed exposing the second open end 27 of the support structure 16.

Figure 6:
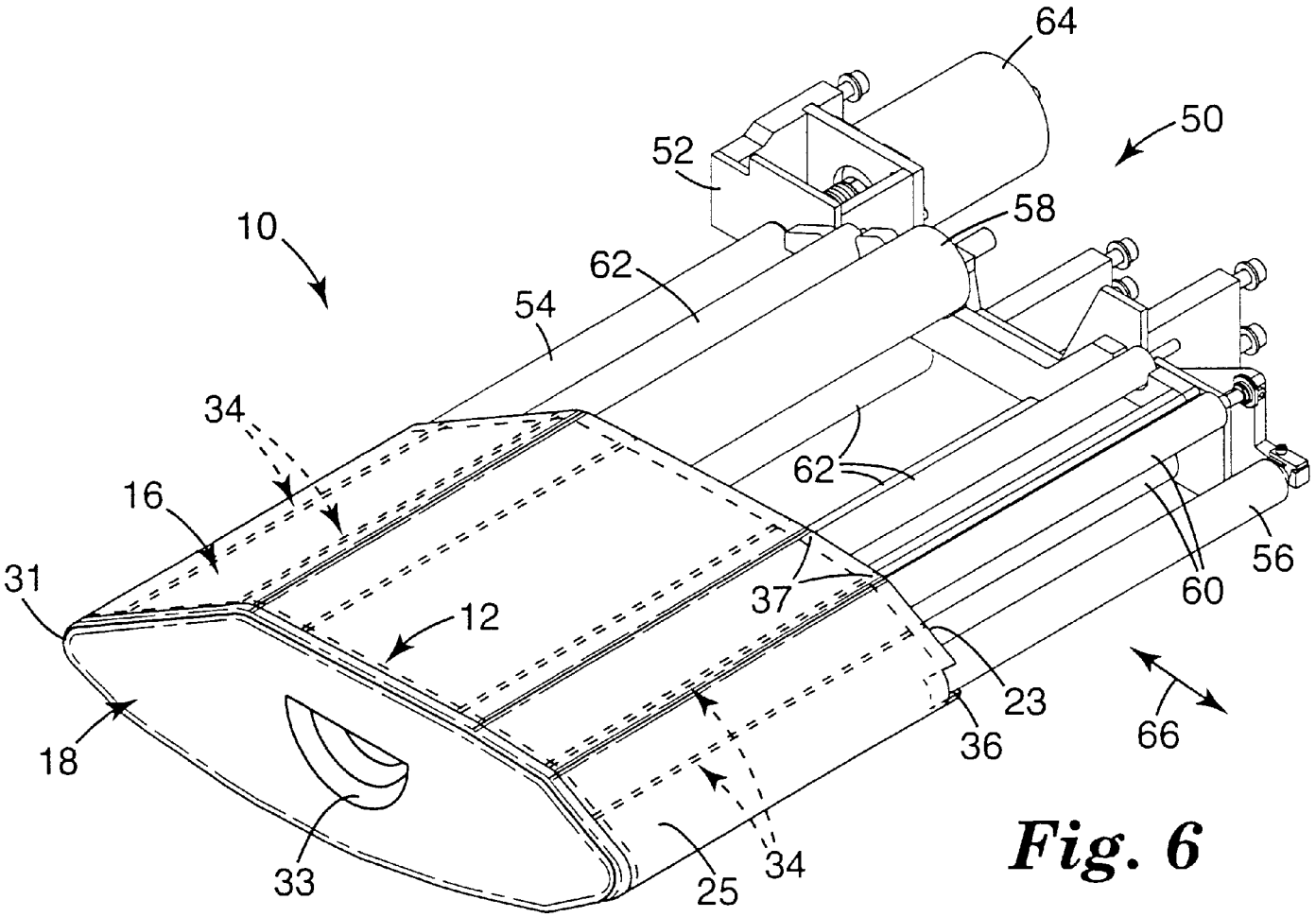
FIG. 6 is a perspective view showing the cartridge device of FIG. 1 surrounding an organic photoreceptor belt and being moved onto the support roller system of the electrophotographic printer.
Figure 7:
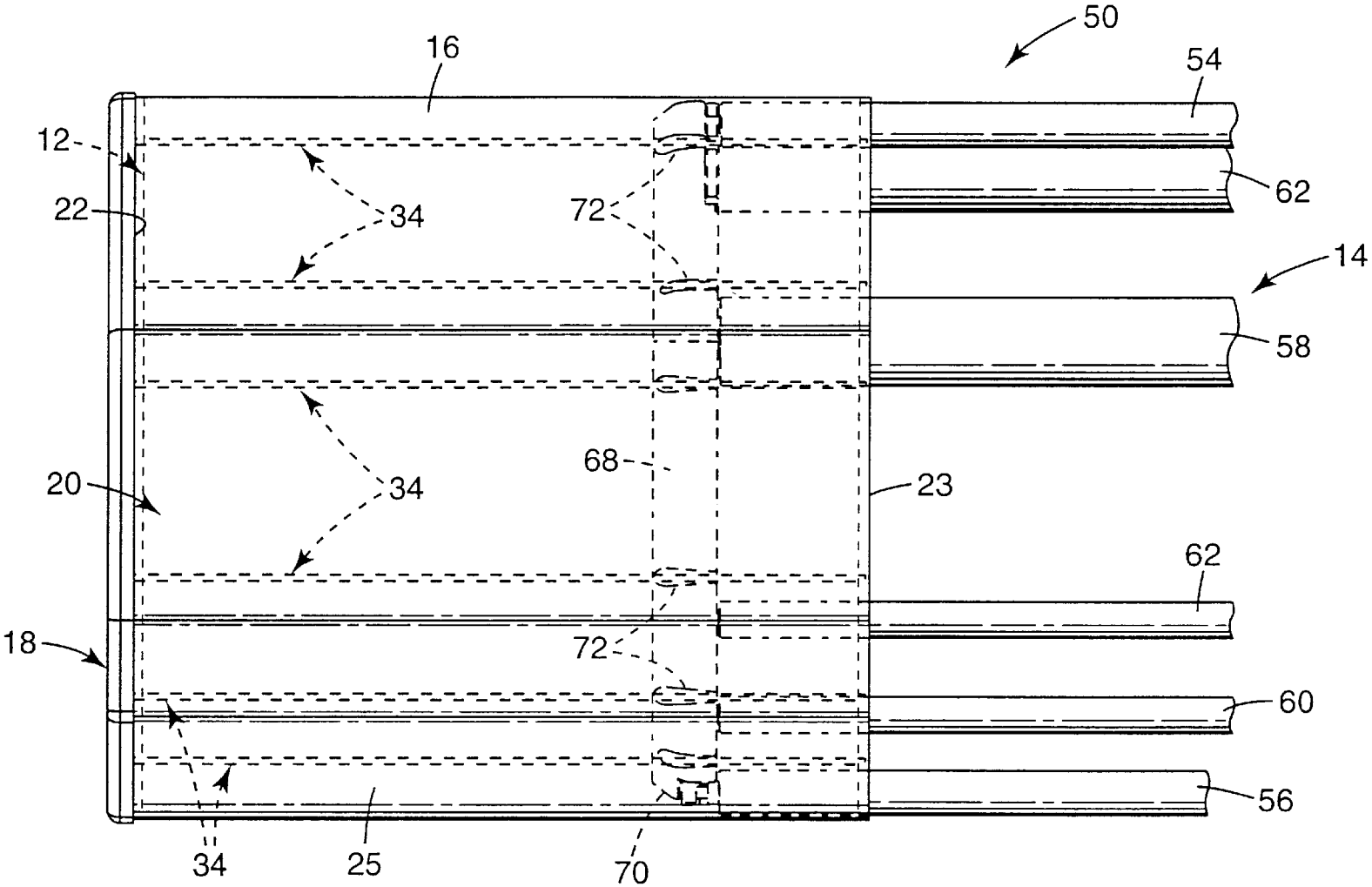
FIG. 7 is a top elevational view illustrating a cone-shaped tip member of the support roller system that facilitates insertion of the cartridge device with an organic photoreceptor belt therein onto the support roller system of the electrophotographic printer.
Figure 8:
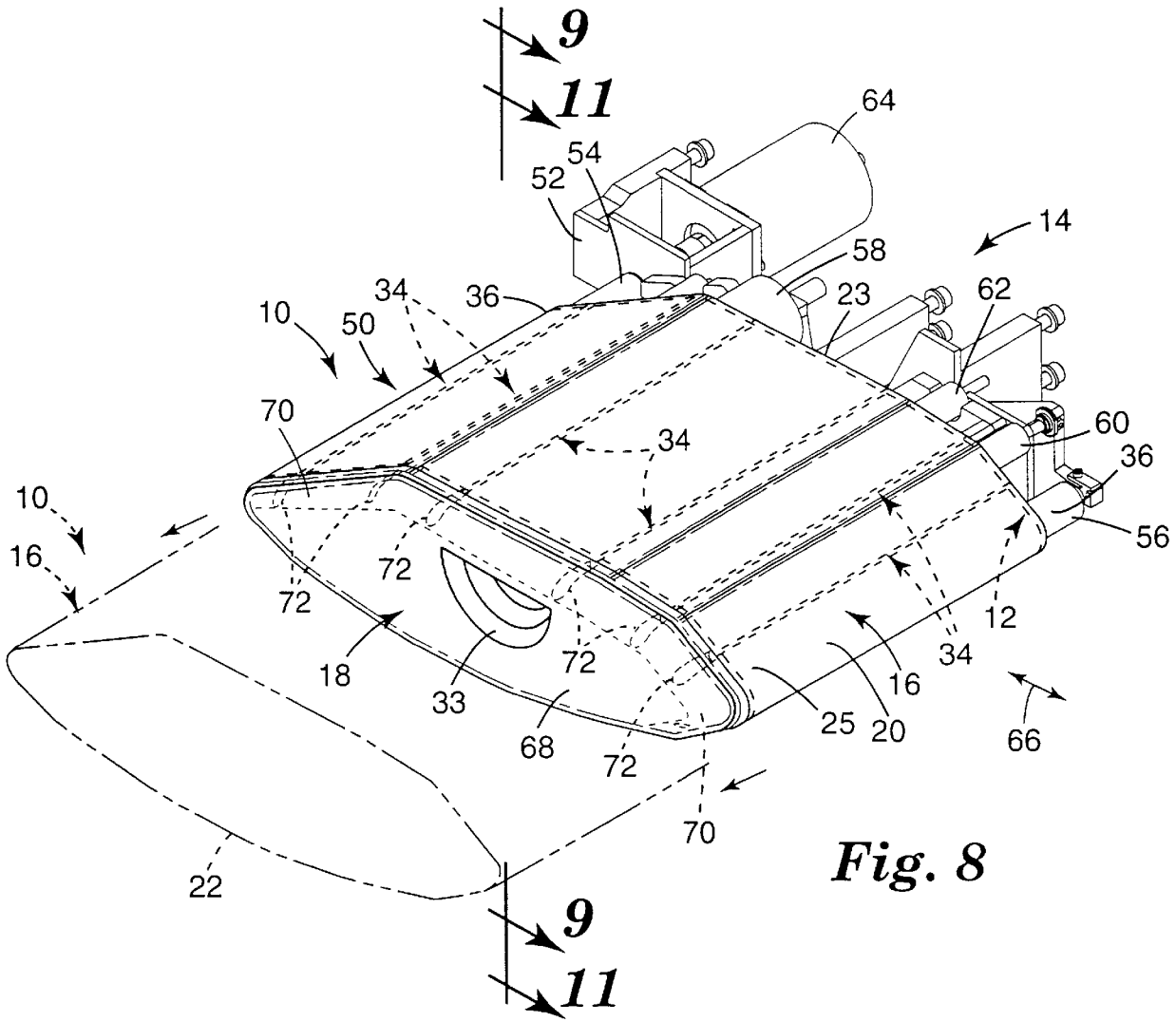
FIG. 8 is a perspective view similar to FIG. 6 showing the cartridge device with organic photoreceptor belt therein fully inserted over the support roller system of the electrophotographic printer.
Figures 9, 10:
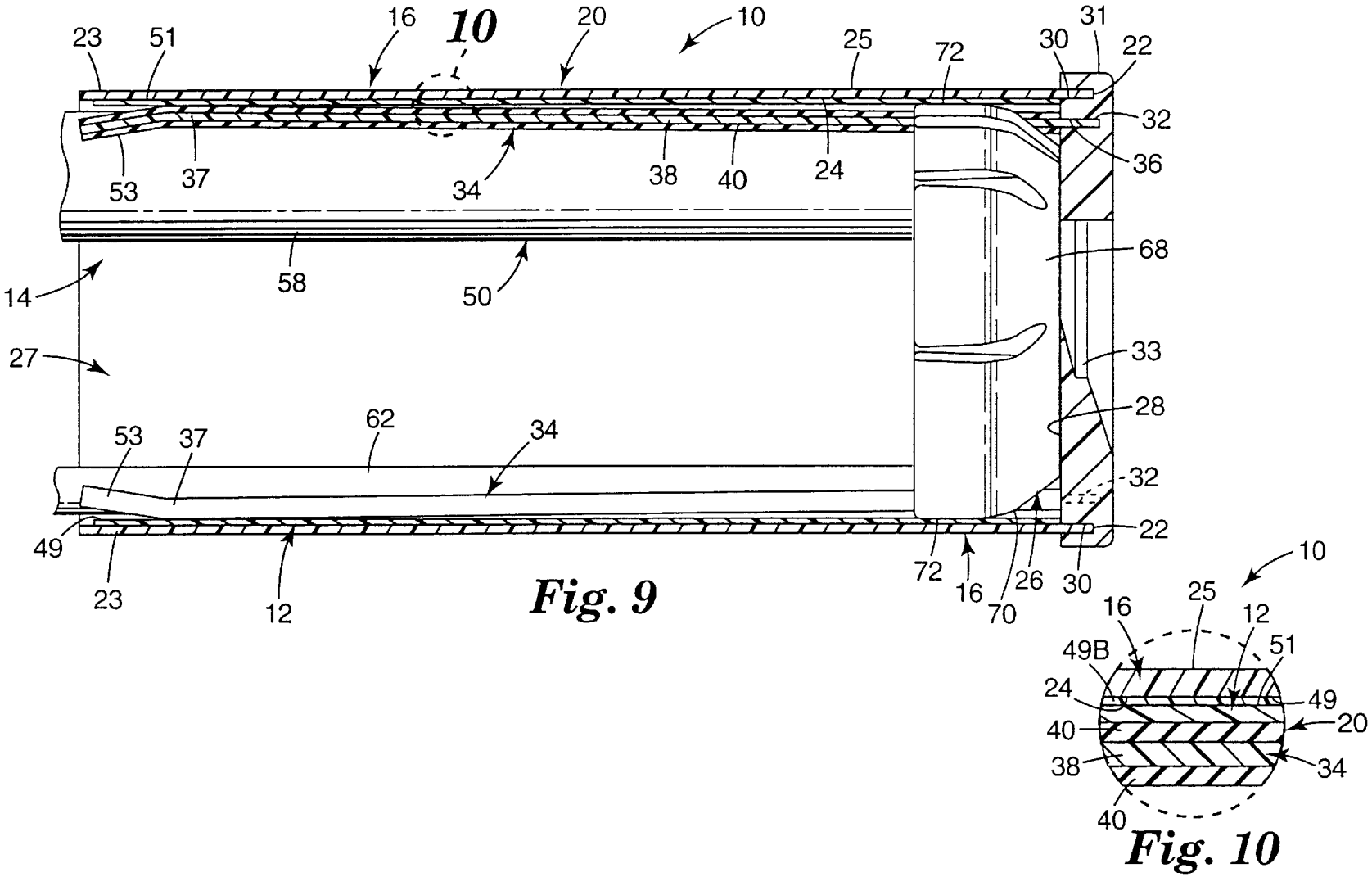
FIG. 9 is a sectional view taken along line 9—9 in FIG. 8 prior to tensioning of the organic photoreceptor belt.
FIG. 10 is a greatly enlarged sectional view of the detail within the circle of FIG. 9.
Figure 11:
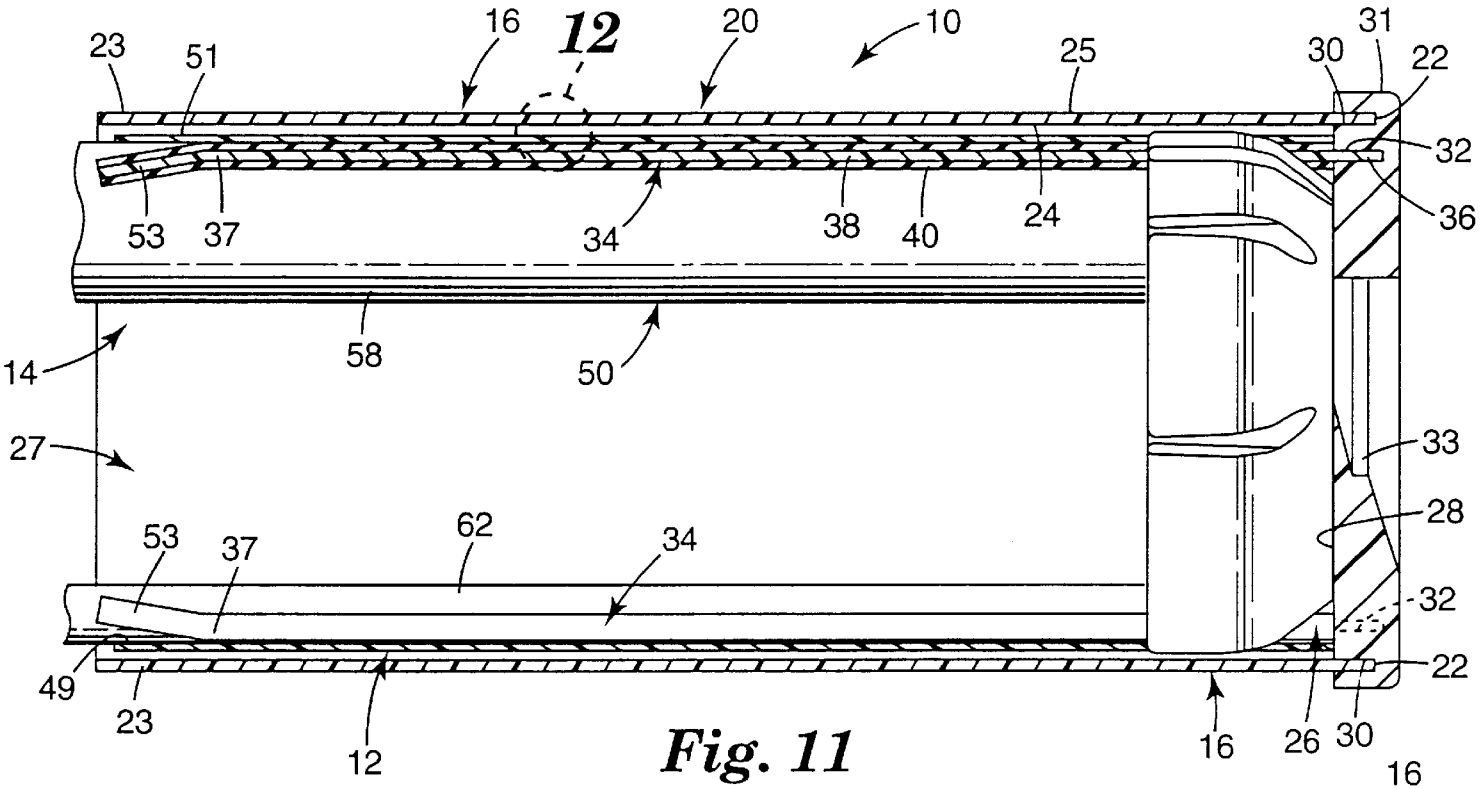
FIG. 11 is a sectional view taken along line 11—11 in FIG. 8 subsequent to tensioning of the organic photoreceptor belt.
Figure 12:
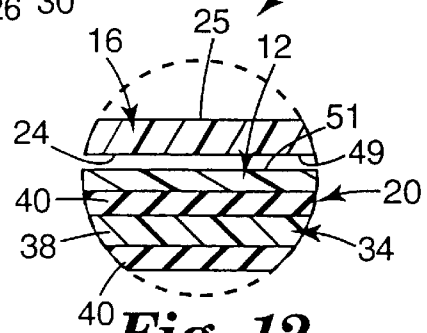
FIG. 12 is a greatly enlarged sectional view of the detail within the circle of FIG. 11.

As seen best in FIG. 6, the user next aligns the belt loading shaped, hard cartridge device 10 with the support roller system 50 such that the shape of the cartridge device 10 matches that shape of the roller system 50 (i.e., the tip member 68). If the hard cartridge device 10 is properly aligned with the tip member 68, the resilient members 34 will line up with the notches 72 in the tip member 68 (see FIG. 7). The hard cartridge device 10, with the replacement organic photoreceptor belt 12 held therein via the resilient members 34, is then slid, by the user, fully onto the support roller system 50 (see FIG. 8) such that the inner surface 49 of the organic photoreceptor belt 12 extends around the rollers 54, 56, 58 60 and 62. As seen best in FIG. 7, the cone shaped peripheral edge 70 of the tip member 68 and the interengagement of the resilient members 34 and the notches 72 facilitate loading of the cartridge device 10 by guiding the cartridge device 10 onto and over the support roller system 50 of the electrophotographic printer 14. As seen in FIGS. 9 and 10, in this position of the cartridge device 10, the resilient members 34 are in their normal set state (i.e., first position) and provide a holding force that holds the replacement organic photoreceptor belt 12 against the inner surface 24 of the support structure 16.

With the hard cartridge device 10 fully on the support roller system 50, the belt tensioning roller 56 is caused to move from its de-tensioned state to its tensioned state (see the double headed arrow 66) (e.g., manually by the user or automatically de-tensioned by the electrophotographic printer). This movement of the belt tensioning roller 56 tensions the replacement organic photoreceptor belt 12 about the roller system 50 because the roller system 50 expands in size. In addition, this tensioning of the replacement organic photoreceptor belt 12, due to movement of the belt tensioning roller 56 away from the drive roller 54, forces the belt 12 outward at the end regions 43 and 44 of the support structure 16, which causes a corresponding decrease in the size of the gap 55. As seen best in FIGS. 11 and 12, this tensioning of the replacement organic photoreceptor belt 12 provides an outer force that causes the resilient members 34 to be pulled away (i.e., flexed) from the inner surface 24 of the support structure 16, which in turn removes the outer organic photoreceptor coated surface 51 of the organic photoreceptor belt 12 out of engagement with the inner surface 24. This is referred to as a released state or a second position of the resilient members 34 since the holding force provided by the resilient members 34 has been removed. With the replacement organic photoreceptor belt 12 fully tensioned, the roller system 50 exerts a greater holding force on the organic photoreceptor belt 12 than any remaining holding force exerted by the resilient members 34. This holding force exerted by the tensioned roller system 50 fixes the endless, replacement organic photoreceptor belt 12 in place and allows the user, by grasping the handle 33, to slide the cartridge device 10 out from around the organic photoreceptor belt 12 and the roller system 50. Since the outer organic photoreceptor coated surface 51 of the organic photoreceptor belt 12 is not engaging (i.e., touching) the inner surface 24 of the support structure 16, the outer organic photoreceptor coated surface 51 is not subject to damage (i.e., scratches and abrasions) as a result of the hard cartridge device 10 being slid out from around the organic photoreceptor belt 12.

Figure 13:
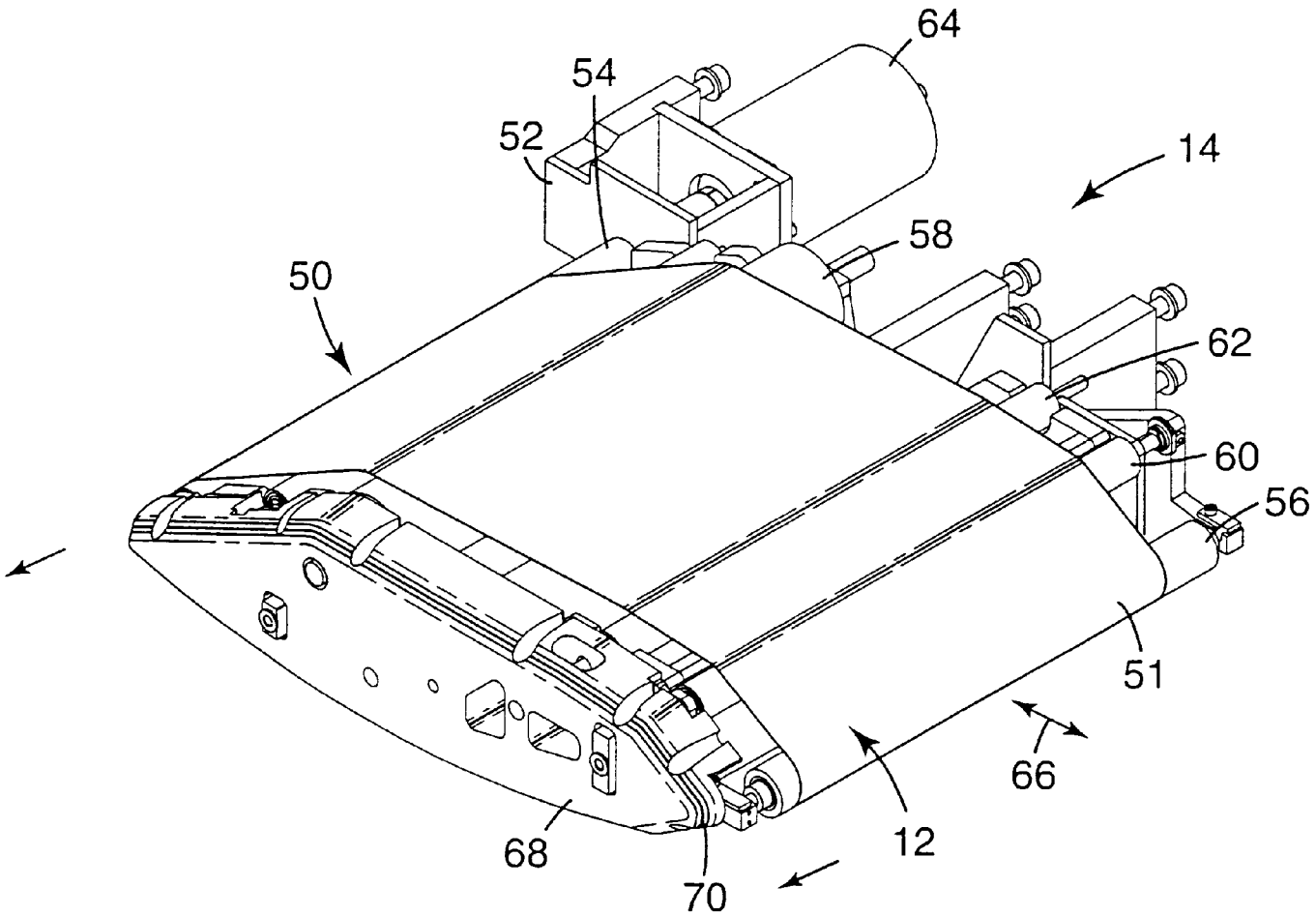
FIG. 13 is a perspective view similar to FIG. 9 of the support roller system with the organic photoreceptor belt thereon and with the cartridge device removed therefrom.

As seen best in FIG. 13, this action removes the hard cartridge device 10 from the electrophotographic printer 14 leaving the replacement organic photoreceptor belt 12 in place on the support roller system 50, thereby completing the belt replacement process. Since the width of the hard cartridge device 10 is greater than the width of the organic photoreceptor belt 12, the user need never touch the replacement organic photoreceptor belt 12 during the entire replacement process. The now empty hard cartridge device 10 is then recycled or is preferably returned to a manufacturing facility so that it can be loaded with another replacement organic photoreceptor belt 12 and reused.

The hard cartridge device 10 of the present invention protects the belt 12, from damaging bends and creases that would adversely affect the image reproduction quality of the replacement organic photoreceptor belt 12. In addition, the cartridge device 10 protects the fragile outer organic photoreceptor coated surface 51 of the belt 12 from other damage, in the form of finger prints, scratches and/or abrasions, caused by organic photoreceptor belt mishandling by office personnel during the replacement process. The cartridge device 10 provides protection during the organic photoreceptor belt replacement process since office personnel need only touch the cartridge device 10 during the replacement process and not the organic photoreceptor belt 12 itself. In addition to providing organic photoreceptor belt protection, the hard cartridge device 10 of the present invention minimizes, when compared to prior art cartridge designs, the amount of consumables that must be disposed of as a result of the organic photoreceptor belt replacement process, since the cartridge device 10 is reusable and/or recyclable. Moreover, the cartridge device 10 of the present invention is manufactured of light weight materials so as to minimize the shipping weight of the replacement organic photoreceptor belt 12, which in turn minimizes shipping costs. Lastly, this hard cartridge device 10 also provides these features while being relatively easy and inexpensive to manufacture.

Aside from the hard cartridge device 10 protecting the belt 12 during installation, the present invention has many other advantages. The hard cartridge provides a means to accomplish the operation of allowing a user to install a organic photoreceptor belt 12 without damaging the belt or requiring the removing of unnecessary consumables. The hard cartridge device 10 may optionally be used to remove the organic photoreceptor belt 12. The hard cartridge device allows belt installation to be an easy, ergonomically friendly installation procedure which is more reliable than known belt installation techniques. Further, by allowing the belt to be installed/changed out without the wasting of other unnecessary consumables, the present invention has many economic advantages. The hard cartridge device 10 itself is recyclable and reusable.

Although the present invention has been described with reference to preferred embodiments, workers skilled in the art will recognize that changes may be made in form and detail without departing from the spirit and scope of the invention.

We claim:

1. A cartridge device for packaging an endless photoreceptor belt of an image forming apparatus, the cartridge device comprising:

a substantially rigid, closed loop structure for supporting an endless photoreceptor belt, the closed loop support structure having an inner surface and an outer surface; and a retaining mechanism associated with the closed loop support structure extending across the inner surface of the support structure and the belt, engaging the endless belt and releasably holding the belt against the inner surface of the support structure, such that the endless belt substantially conforms to a shape of the support structure.

2. The cartridge device of claim 1 wherein the shape of the closed loop support structure substantially duplicates a configuration of the endless belt when the belt is mounted onto support rollers of an image forming apparatus, so as to facilitate loading of the belt onto the support rollers.

3. The cartridge device of claim 1 wherein the closed loop support structure has a first open end and an opposite second open end, and wherein the cartridge device includes:

a cap feature for closing off the first open end of the closed loop support structure.

4. The cartridge device of claim 3 wherein the cap feature includes a handle to facilitate handling of the cartridge device.

5. The cartridge device of claim 3, wherein the closed loop support structure and cap feature comprise a single molded unit.

6. The cartridge device of claim 3 wherein the retaining mechanism is mounted to the cap feature of the cartridge device.

7. The cartridge device of claim 1 wherein the retaining mechanism is movable between a first position and a second position, and wherein one of the first and second positions is a normal set state of the retaining mechanism and the other one of the first and second positions is held in that state by an external force.

8. The cartridge device of claim 7 wherein in the first position of the retaining mechanism the endless photoreceptor belt is substantially held against the inner surface of the support structure by a holding force provided by the retaining mechanism.

9. The cartridge device of claim 8 wherein in the second position of the retaining mechanism, the endless photoreceptor belt is disengaged from the inner surface of the support structure which at least partially releases the holding force provided by the retaining mechanism.

10. The cartridge device of claim 9 wherein the first position of the retaining mechanism is the normal set state of the retaining mechanism.

11. The cartridge device of claim 10 wherein the movement of the retaining mechanism between its first and second positions is due to flexing of the retaining mechanism.

12. A cartridge device for packaging an endless photoreceptor belt of an image forming apparatus, the cartridge device comprising:

a substantially rigid, closed loop structure for supporting an endless photoreceptor belt, the closed loop support structure having an inner surface and an outer surface;

a retaining mechanism associated with the closed loop support structure engaging the endless belt and releasably holding the belt against the inner surface of the support structure, such that the endless belt substantially conforms to a shape of the support structure, and wherein the closed loop support structure has a first open end and an opposite second open end, and wherein the cartridge device includes a cap feature for closing off the first open end of the closed loop support structure, and wherein the closed loop support structure has first and second, opposite side edges, and wherein a peripheral edge of the cap feature includes a channel adapted to receive the first side edge of the support structure for mounting the cap feature to the support structure.

13. A cartridge device for packaging an endless photoreceptor belt of an image forming apparatus, the cartridge device comprising:

a substantially rigid, closed loop structure for supporting an endless photoreceptor belt, the closed loop support structure having an inner surface and an outer surface;

a retaining mechanism associated with the closed loop support structure engaging the endless belt and releasably holding the belt against the inner surface of the support structure, such that the endless belt substantially conforms to a shape of the support structure; and wherein the closed loop support structure has a first open end and an opposite second open end, and wherein the cartridge device includes a cap feature for closing off the first open end of the closed loop support structure; and wherein the retaining mechanism is mounted to the cap feature of the cartridge device; and wherein the retaining mechanism includes a plurality of spaced, resilient members that extend from the cap feature toward the second open end of the closed loop support structure, the resilient members engaging an inner surface of the photoreceptor belt to hold the photoreceptor belt against the inner surface of the support structure.

14. The cartridge device of claim 13 wherein each of the resilient members is covered with a protective coating to protect the endless belt.

15. The cartridge device of claim 14, wherein each of the resilient members includes a proximal end at the cap feature and a distal end opposite the proximal end, and wherein the distal end of each of the resilient members is formed with an angled bend portion that extends away from the inner surface of the closed loop support structure.

16. The cartridge device of claim 13 wherein each of the resilient members has a proximal end and a distal end, and wherein a peripheral edge of the cap feature includes a plurality of spaced apertures adapted to receive the proximal ends of the resilient members for mounting the resilient members to the cap feature of the cartridge device.

17. A cartridge device for packaging an endless photoreceptor belt of an image forming apparatus, the cartridge device comprising:

a substantially rigid, closed loop structure for supporting an endless photoreceptor belt, the closed loop support structure having an inner surface and an outer surface; and a retaining mechanism associated with the closed loop support structure engaging the endless belt and releasably holding the belt against the inner surface of the support structure, such that the endless belt substantially conforms to a shape of the support structure, wherein the retaining mechanism is movable between a first position and a second position, and wherein one of the first and second positions is a normal set state of the retaining mechanism and the other one of the first and second positions is held in that state by an external force, wherein in the first position of the retaining mechanism the endless photoreceptor belt is substantially held against the inner surface of the support structure by a holding force provided by the retaining mechanism, wherein in the second position of the retaining mechanism, the endless photoreceptor belt is disengaged from the inner surface of the support structure which at least partially releases the holding force provided by the retaining mechanism, wherein the first position of the retaining mechanism is the normal set state of the retaining mechanism and wherein the endless photoreceptor belt is loaded onto the support rollers of the image forming apparatus by inserting the closed loop support structure with the belt supported therein over the support rollers, and wherein tensioning of the belt on the support rollers provides the external force that causes the retaining mechanism to flex from its first position to its second position, allowing the closed loop support structure to be removed from around the belt and the support rollers, leaving only the belt on the support rollers of the image forming apparatus.

18. A method of loading an endless photoreceptor belt onto support rollers of a support roller system of an image forming apparatus, the method comprising the steps of:

providing a cartridge device including a substantially rigid, closed loop support structure having retaining mechanism extending across an inner surface of the support structure for releasably holding an endless photoreceptor belt against the inner surface of the support structure, the support structure with the belt therein having a configuration that substantially duplicates a configuration of support rollers of the image forming apparatus;

aligning the closed loop support structure with the support rollers of the image forming apparatus such that the configuration of the support structure matches the configuration of the support rollers;

moving the closed loop support structure onto the support rollers such that the support structure, with the endless photoreceptor belt supported therein, is fully on the support rollers;

tensioning the endless photoreceptor belt on the support rollers so as to fix the belt against movement relative to the support rollers; and removing the closed loop support structure from around the endless photoreceptor belt and the support rollers leaving only the belt on the support rollers of the image forming apparatus to make the belt ready for image reproduction.

19. The method of claim 18, wherein the step of moving the closed loop support structure onto the support rollers includes the step of positioning the closed loop support structure over a tip member operably shaped to receive the closed loop support structure.

20. The method of claim 18 wherein the cartridge device further includes a cap feature, and wherein the step of removing the closed loop support structure from around the endless photoreceptor belt and the support rollers includes the steps of:

grasping a grip mechanism on the cap feature to facilitate removal of the support structure from around the belt and the support rollers.

21. A method of loading an endless photoreceptor belt onto support rollers of a support roller system of an image forming apparatus, the method comprising the steps of:

providing a cartridge device including a substantially rigid, closed loop support structure having retaining mechanism for releasably holding an endless photoreceptor belt against an inner surface of the support structure, the support structure with the belt therein having a configuration that substantially duplicates a configuration of support rollers of the image forming apparatus;

aligning the closed loop support structure with the support rollers of the image forming apparatus such that the configuration of the support structure matches the configuration of the support rollers;

moving the closed loop support structure onto the support rollers such that the support structure, with the endless photoreceptor belt supported therein, is fully on the support rollers;

tensioning the endless photoreceptor belt on the support rollers so as to fix the belt against movement relative to the support rollers;

removing the closed loop support structure from around the endless photoreceptor belt and the support rollers leaving only the belt on the support rollers of the image forming apparatus to make the belt ready for image reproduction; and wherein the step of tensioning the endless photoreceptor belt on the support rollers includes the step of flexing the retaining mechanism to disengage the belt from the inner surface of the support structure.

22. A method of loading an endless photoreceptor belt onto support rollers of a support roller system of an image forming apparatus, the method comprising the steps of:

providing a cartridge device including a substantially rigid, closed loop support structure having retaining mechanism for releasably holding an endless photoreceptor belt against an inner surface of the support structure, the support structure with the belt therein having a configuration that substantially duplicates a configuration of support rollers of the image forming apparatus;

aligning the closed loop support structure with the support rollers of the image forming apparatus such that the configuration of the support structure matches the configuration of the support rollers;

moving the closed loop support structure onto the support rollers such that the support structure, with the endless photoreceptor belt supported therein, is fully on the support rollers;

tensioning the endless photoreceptor belt on the support rollers so as to fix the belt against movement relative to the support rollers;

removing the closed loop support structure from around the endless photoreceptor belt and the support rollers leaving only the belt on the support rollers of the image forming apparatus to make the belt ready for image reproduction; and wherein the retaining mechanism includes a plurality of spaced resilient members, and wherein the step of aligning the closed loop support structure with the support rollers includes the step of aligning the spaced resilient members with corresponding notches on a tip member associated with the support rollers.

* * * * *